United States Patent [19]

Theilen et al.

[11] Patent Number: 4,460,287

[45] Date of Patent: Jul. 17, 1984

[54] RIBBON LIFT MECHANISM FOR TYPEWRITERS AND THE LIKE MACHINES

[75] Inventors: Rolf Theilen, Furth; Manfred Kleinhanns, Feucht, both of Fed. Rep. of Germany

[73] Assignee: Triumph-Adler A.G. fur Buro- und Informationstechnik, Nuremberg, Fed. Rep. of Germany

[21] Appl. No.: 475,901

[22] Filed: Mar. 16, 1983

[30] Foreign Application Priority Data

Mar. 24, 1982 [DE] Fed. Rep. of Germany ..... 3210723

[51] Int. Cl.[3] ..... B41J 35/10

[52] U.S. Cl. ..... 400/213.1; 400/216

[58] Field of Search ..... 400/212, 213, 213.1, 400/216, 217, 224, 215

[56] References Cited

U.S. PATENT DOCUMENTS 824,581 6/1906 Pool ..... 400/213.1
2,734,613 2/1956 Kennedy, Jr. et al. ..... 400/376
4,353,657 10/1982 Schaefer ..... 400/213 X
4,411,541 10/1983 Mansfeld et al. ..... 400/213

FOREIGN PATENT DOCUMENTS 186289 11/1936 Switzerland ..... 400/213.1

*Primary Examiner*—Edgar S. Burr
*Assistant Examiner*—Charles A. Pearson
*Attorney, Agent, or Firm*—Joseph R. Spalla

[57] ABSTRACT

An improved ribbon lift mechanism for alternately raising a ribbon from a lowered position to first and second elevations relative to a print line. A ribbon lift lever is raised by a cam ring having alternating high and low lift cams separated by valleys for acting on a cam follower directly connected to the ribbon lift lever. The cam ring is indexable by a cyclically movable powered lever which acts to control a locking lever to lock the raised ribbon lift lever at said first and second elevations and to release it for return to lowered position incident to a cycle of the powered lever. The arrangement allows an economy of parts and operation by a relatively weak power source.

4 Claims, 4 Drawing Figures

RIBBON LIFT MECHANISM FOR TYPEWRITERS AND THE LIKE MACHINES

This invention relates to a ribbon lifting mechanism for typewriters or like machines; more particularly it relates to a ribbon lift mechanism for raising a ribbon alternately to first and second elevations from a lowered position directly by an indexable cam; and specifically it relates to a ribbon lift mechanism having locking means for locking the ribbon at the first and second elevations operable in timed relation to said cam indexing.

A related copending application of Mansfeld, et al Ser. No. 343,117 filed Jan. 27, 1982 now U.S. Pat. No. 4,411,541 discloses ribbon lift mechanism of the type disclosed herein which together with ribbon transport mechanism can be accommodated in a small space. This invention is an improvement in the lift mechanism disclosed in said copending application in that it provides a greater economy of parts which can be operated with an electromagnet of shorter stroke and with lower power.

In accordance with the invention an indexable double lift cam ring having high and low cams separated by valleys acts directly on the ribbon lift lever to raise it to first and second elevations. A magnet powered lever carrying a pawl for indexing the cam ring also interacts directly with a locking lever to effect locking of the ribbon lift lever in timed relation to its movement to its first and second elevations by the cam ring. The economy of parts reduces friction losses enabling a weaker electromagnet to be used.

An object of the invention is in the provision of an improved ribbon lifting mechanism characterized by an economy of parts offering low resistance to movement allowing use of an electromagnet of short stroke and low power.

Another object of the invention is in the provision of a ribbon lift mechanism for raising a ribbon to different elevations relative to a printing line operating in timed relation with an adjustable locking means for holding a ribbon lift lever at a given elevation relative to the printing line.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
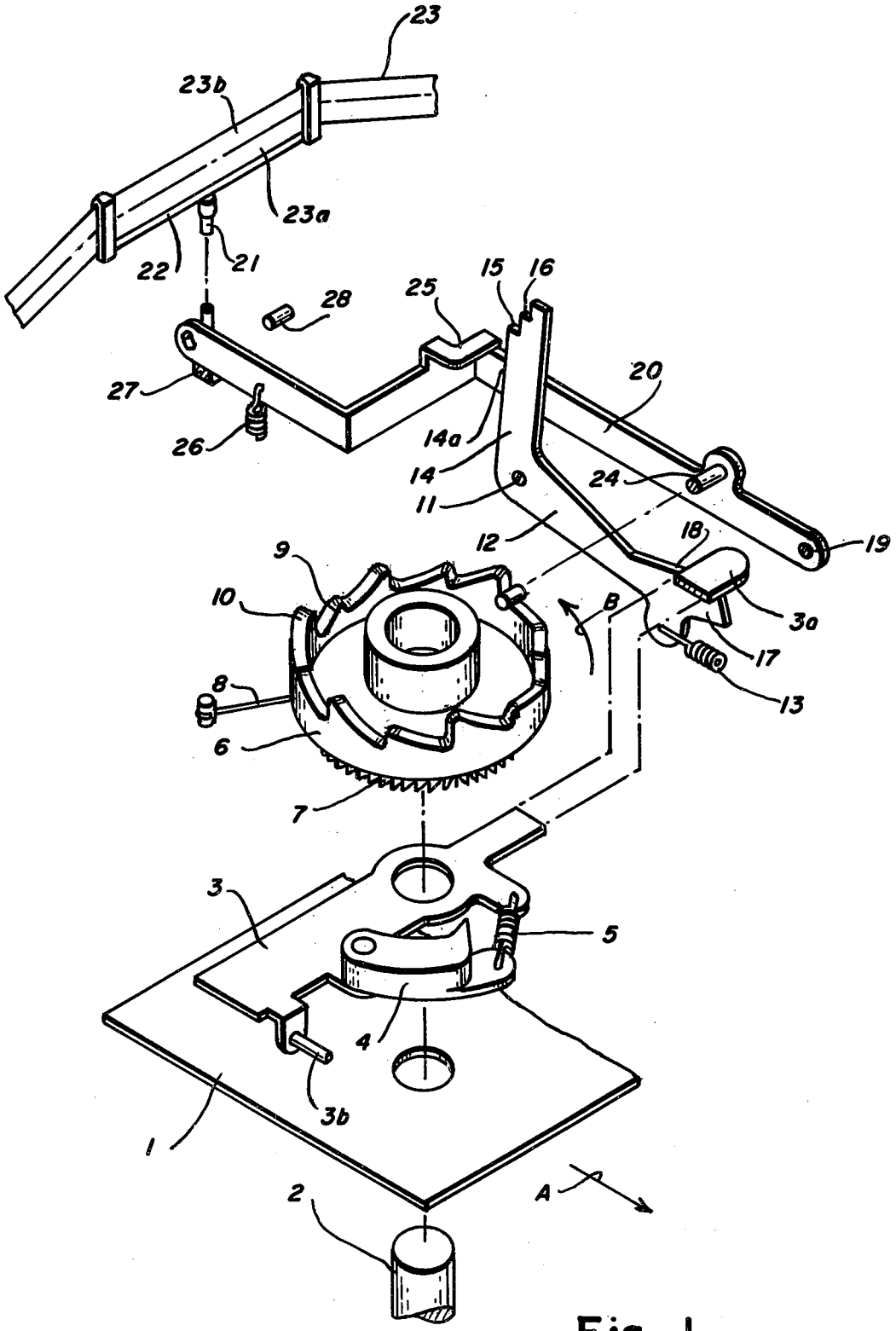
FIG. 1 is an exploded perspective view of ribbon lift mechanism in accordance with the invention.

Referring now to the drawings there is shown in FIG. 1 a base plate 1 comprising part of the machine frame or of a type carrier carriage. The base plate 1 serves to seat a shaft 2 which permits the pivotable mounting of a pivoting lever 3 which rotatably mounts a pawl 4. The pawl 4 is spring-loaded against the pivoting lever 3 by means of a spring 5. Rotatably mounted above the pivoting lever 3 on shaft 2 is a cup-shaped lift control wheel 6 which has on its underside a ratchet wheel 7 which interacts with the pawl 4. In addition, the bent end of a wire detent spring 8 projects into the ring gear 7 to preclude reverse rotation. The edge of the lift control wheel 6 is formed to provide low and high lift cams 9 and 10 which are separated by valleys and extend axially upward.

Pivoting on a pivot pin 11 is an angular locking lever 12 which is biased counterclockwise as viewed in the Figure by the action of an extension spring 13. The arm 14 of locking lever 12 has two locking edges 15 and 16 disposed at different levels. The other arm 17 of the pivoting lever 12 is provided at its upper edge with a bevel 18 which interacts with an arm 3*a* of pivoting lever 3 for reasons hereafter described.

Mounted on another pivot pin 19 is a ribbon lift lever 20 which is connected to a ribbon guide 22 for a ribbon 23 by means of a rod 21 connected to the end of the ribbon lift lever 20. The ribbon lift mechanism is designed to lift the ribbon 23 in alternation from a lowered position to two different elevations 23*a*, 23*b* relative to a printing line. Extending from the ribbon lift lever 20 is a cam follower in the form of a round pin 24. Furthermore, the ribbon lift lever 20 has a tab 25 which is adjustable and interacts with the locking edges 15 and 16 on the locking lever 12. An extension spring 26 biases the lift lever 20 to its lowered position against the lower one of two stops 27 and 28 located in the range of motion of the lift lever 20.

Figure 2:
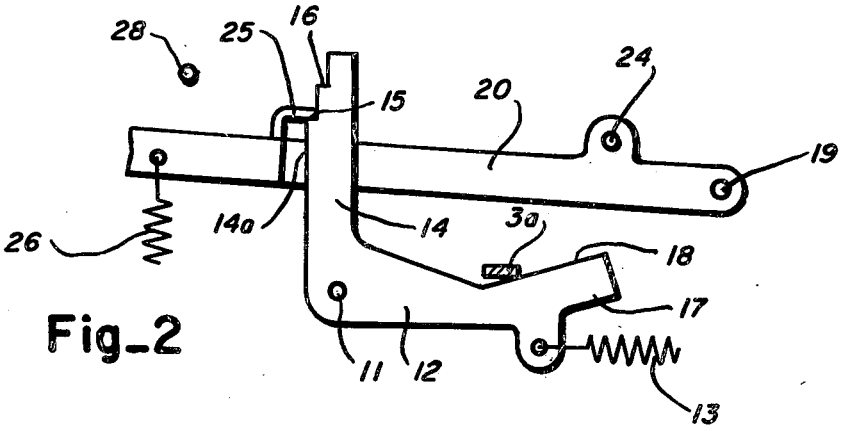
FIG. 2 is an elevational view showing locking means for holding the ribbon lift lever in a raised position.

The function of the device will now be described with reference to FIGS. 1 and 2. In the normal position of the device, the pawl 4 on the pivoting lever 3 engages the ratchet wheel 7 of the lift control wheel 6. Also the arm 3*a* of the pivoting lever 3 bears against the free end of arm 17 on the locking lever 12, holding it against the force of spring 13 is a normal position with its arm 14 just touching the tab 25 on the ribbon lift lever 20. The spring 26 keeps the ribbon lift lever 20 against the stop 27 so that the ribbon 23 is in its basic lowered position in which the view of the typed line is free. In the lowered position, the cam follower 24 of the ribbon lift lever 20 lies in a valley between the low and high lift cams 9 and 10 of the lift control wheel 6.

For instance, by means of an electromagnet (not shown) a pull in direction of arrow A can be exerted on the pivoting lever 3 via a pull rod 3*b*. Lever 3 will then pivot in arrow direction B by a precisely defined angle of rotation. In the process, the pawl 4 will rotatably index the lift control wheel 6 by means of the ratchet wheel 7 so that the cam follower 24 rides up a flank to the top of the cam 9 or 10 next following in the direction of rotation of the lift control wheel 6. The height of the respective cam 9 or 10 determines to which one of the two elevations 23*a* or 23*b* the ribbon 23 is lifted by the ribbon lift lever 20.

During the pivoting motion of the pivoting lever 3 in arrow direction B its arm 3*a*, simultaneously during the lifting motion of the ribbon lift lever 20, slides along the bevel 18 of the locking lever 12 in arrow direction B. Due to this bevel 18 the locking lever biasing spring 13 is now able to pivot the locking lever 12 counterclockwise toward the tab 25 on the ribbon lift lever 20. The motion cycle between locking lever 12 and ribbon lift lever 20 is peferably chosen so that the edge 14*a* of the arm 14 of the locking lever 12 is in contact with the tab 25 of the ribbon lift lever 20 before the latter reaches one of the two lifting levels 23*a* or 23*b*. If the cam follower 24 on the ribbon lift lever 20 is on a low lift cam 9 of the lift control wheel 4, the tab 25 will snap over the lower locking edge 15 of the locking lever 12 and hold the ribbon 23 in the typing plane 23*b* (FIG. 2).

After the character has been typed, the pivoting lever 3 returns into its normal position and its arm 3*a*, acting on the bevelled edge 18 of the locking lever 12, restores the locking lever to its normal position countering the force of spring 13. This moves the locking edge 15 away from the tab 25 of the ribbon lift lever 20, causing the spring 26 to pull the ribbon lift lever 20 against the lower stop 27. This causes the ribbon 23 to return to its lowered position. During the return motion of the pivoting lever 3 the pawl 4 slides across the teeth of the ratchet wheel 7. The detent spring 8 sees to it that the lift control wheel 6 does not rotate reversely unintentionally. During the next typing process the motions of the various components repeat essentially, except that this time the cam follower 24 rides up the flank to the top of a high lift cam 10 so that the ribbon 23 is lifted to the typing plane 23*a*. The tab 25 on the ribbon lift lever 20 will then position itself on top of the locking edge 16 on the locking lever 12. The total upward motion of the lift lever 20 can be limited by means of the stop 28.

The device thus makes it possible, simply and safely, using few components and without having to overcome much friction within the drive chain, to lift the ribbon in alternation to one of the two elevations 23*a* and 23*b*.

Figure 3:
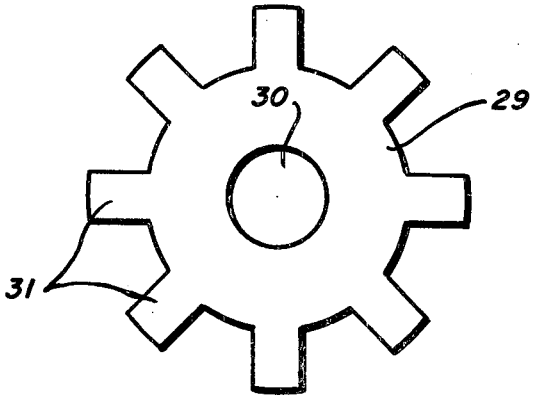
FIG. 3 is an elevational view of an overtravel preventing part.
Figure 4:
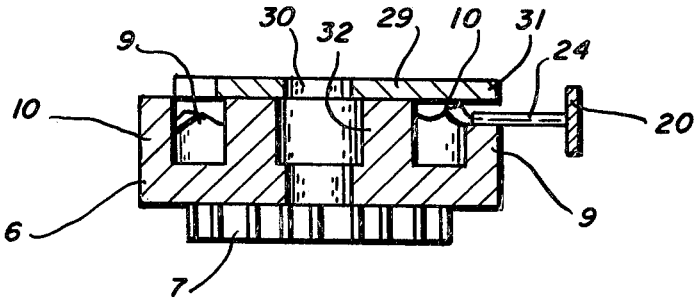
FIG. 4 is cross sectional view of the cam ring with the part shown in FIG. 3 mounted.

Due to mass inertia conditions and certain accelerations it may happen in typewriters and printers that the ribbon 23 together with the ribbon lift lever 20 tends to overtravel when lifted to elevation 23*b*. In order to prevent this and with reference to FIGS. 3 and 4, there is provided a disc 29 with a center hole 30 and projections 31 projecting radially outward. The projections 31 are arranged at an angle to each other which corresponds exactly to the angle in which the low lift cams 9 of the lift control wheel 6 lie relative to each other. The lift control wheel 6 is additionally provided with an inner annular collar 32 on which the disc 29 can be placed. The height of the collar 32 is such that the projections 31 of disc 29 are located opposite the cams 9 of the lift control wheel 6 at an axial spacing therefrom only slightly greater than the thickness of the cam follower 24 on the ribbon lift lever 20 as shown in FIG. 4. The disc 29 and the lift control wheel 6 are suitably connected to each other so as to corotate, rotating jointly during a cycle of the pivoting lever 3. The projections 31 thus prevent the lift lever 20 from overtraveling upwards beyond elevation 23*b* due to its kinetic energy together with the ribbon 23, because the travel of the lift lever 20 beyond level 23*b* is limited by the interaction of the cam follower 24 with one of the projections 31 on the disc 29. As already explained, the longer stroke of the lift lever 20 to position ribbon at the typing level 23*a* is limited by the stop 28. Overtravel of the ribbon lift lever 20 with the ribbon 23 can thus be prevented in simple maner in both typing planes 23*a* and 23*b*.

Due to the fact that the locking lever 12 is pivotable into its locking position by spring force and is returned into its normal position positively by means of the arm 3*a*, the resultant motion and function cycles are favorable and permit production of the various components without having to adhere to close tolerances. Adjustment of the strokes of the lift lever 20 can easily be accomplished by bending the tab 25. Moreover, a relatively weak magnet can be used, to further reduce the expense of the mechanism.

The present invention is concerned only with lifting the ribbon, not with transporting it. The ribbon may be transported in the same manner described in said copending application of Mansfeld, et al. Therefore, only a single drive as in said copending Application, preferably an electromagnet, is used for lifting and transporting the ribbon in the combination embodying the present invention.

It is to be understood that the lift lever may also be designed as two levers connected by a bridge in which case, both lift levers would be mounted on the shaft 19, with their free ends supporting the guide 22 for the ribbon 23.

The invention claimed is:

1. A typewriter having a ribbon lift mechanism for alternatingly lifting a ribbon from a lowered position to first and second elevations relative to a printing line comprising a support frame, a shaft supported on said frame, a powered lever rotatably mounted on said shaft for cyclic movement from a rest position to an active position and return to rest position to effect ribbon lift, a lift control wheel rotatably mounted on said shaft, said lift control wheel having a cam ring and a ratchet wheel, said lever including a pawl for engaging and indexing said ratchet wheel incident to cyclic movement of said lever, said cam ring having alternating low and high lift cams separated by valleys, a ribbon supporting lift lever pivotally mounted on said frame and biased to its lowered position, a cam follower directly mounted on said ribbon lift lever engaging said cam ring for alternatingly lifting said ribbon lift lever from a lowered position to first and second elevations incident to indexing of said control wheel by said pawl, a locking lever pivotally mounted on said frame, a spring normally biasing said locking lever toward locking engagement with said ribbon lift lever for holding it in said first and second elevated positions, said locking lever having an inclined edge, and an arm on said powered lever overlying said inclined edge of said locking lever for normally holding said locking lever against the bias of its spring out of locking engagement with said ribbon lift lever and movable incident to cyclic movement of said powered lever for releasing said locking lever for lockingly holding said ribbon lift lever at said first and second elevations and for returning said locking lever whereby said ribbon lift lever is released for return to lowered position incident to each cyclic movement of said powered lever.

2. Ribbon lift mechanism as recited in claim 1, said locking lever having a first arm formed with two vertically spaced locking edges for holding said ribbon lift lever at said first and second elevations.

3. Ribbon lift mechanism as recited in claim 2, said ribbon lift lever having tab for engagement by said locking edges.

4. Ribbon lift mechanism as recited in claim 2, including a circular disc mounted to and axially above said cam and having radial projections oriented to limit overtravel of said cam follower beyond said first elevation.

* * * * *